US005715754A

United States Patent [19]

Nishibayashi et al.

[11] Patent Number: 5,715,754

[45] Date of Patent: Feb. 10, 1998

[54] OFFSET PRINTING METHOD

[75] Inventors: Jun Nishibayashi, Kobe; Jun Ochi, Nishiwaki; Hiroaki Kawasaki, Hikami-gun, all of Japan

[73] Assignee: Sumitomo Rubber Industries Ltd., Hyogo, Japan

[21] Appl. No.: 683,412

[22] Filed: Jul. 19, 1996

[30] Foreign Application Priority Data

Jul. 21, 1995 [JP] Japan ..... 7-186002

[51] Int. Cl.[6] ..... B41F 1/16

[52] U.S. Cl. ..... 101/492; 101/215; 101/486; 101/DIG. 36

[58] Field of Search ..... 101/33, 34, 41, 101/93, 146, 158, 164, 186, 211, 215, 250, 251, 485, 486, 492, DIG. 36

[56] References Cited

U.S. PATENT DOCUMENTS 5,367,953 11/1994 Yamashita et al. ..... 101/158

FOREIGN PATENT DOCUMENTS 06305108A 11/1994 Japan .

*Primary Examiner*—Ren Yan

*Attorney, Agent, or Firm*—Nikaido Marmelstein Murray & Oram LLP

[57] ABSTRACT

An offset printing method is suitable for high-precision printing. Errors caused by the relative movement between a blanket cylinder 4 and a form plate 10 and the rotation of the blanket cylinder 4 on its axis which are produced in a step of transferring an ink image to the blanket cylinder 4 from the form plate 10, are reproduced in the relative movement between the blanket cylinder 4 and a surface to be printed on 11 and the rotation of the blanket cylinder 4 on its axis in a step for printing the ink image on the surface to be printed on 11 from the blanket cylinder 4. The dimensional errors produced in the ink image transferred to the surface 12 of the blanket cylinder 14 of the offset printing methods are cancelled when transferring the ink image from the surface of the blanket cylinder 4 to the surface to be printed on.

4 Claims, 2 Drawing Sheets

OFFSET PRINTING METHOD

BACKGROUND OF THE INVENTION

1. Field of the Invention

The present invention relates to an offset printing method suitable for precise printing of a color filter used for a CRT (Cathode Ray Tube) display, a liquid crystal display or the like, a high-precision electronic circuit, or the like.

2. Description of the Related Art

Conventionally, a so-called photolithographic technique has been utilized for precise pattern formation of a color filter, an electronic circuit, or the like. In recent years, it has been considered whether the printing, done by offset printing would allow simple printing carried out at higher speed.

It has been considered that an offset press for lithography shown in FIGS. 2(*a*) and 2(*b*), for example, might be employed for the above offset printing needed to produce a color filter and/or an electronic circuit.

The above offset press comprises a stand board 91 for holding a flat plate-shaped form plate 10 having an ink image formed on its surface and a surface onto which matter for an ink image is to be printed 11 so that the surface of the form plate 10 and the surface onto which the matter is to be printed 11 are flush with each other, a blanket cylinder 92 having a blanket 12 wound around the outer peripheral surface of the blanket cylinder 92, and two rack gears 94 respectively arranged on both sides of the form plate 10 and the surface onto which matter to be printed 11 on the stand board 91. The two rack gears are with the pinion gears 93.

The blanket cylinder 92 is so disposed as to be movable, together with an air cylinder 95, along a plane which includes the surfaces of the form plate 10 and the surface onto which matter is to be printed 11 with respect to the stand board 91, as indicated by an arrow in FIG. 2(*a*), in a state where both ends of its axis 92*a* are rotatably held in the leading end of the air cylinder 95.

The air cylinder 95 is for changing the height of the blanket cylinder 92 in two stages in order to bring the blanket 12 wound around the outer peripheral surface of the blanket cylinder 92 into contact with the surface of the form plate 10 or the surface onto which matter is to be printed 11 at the time of printing as well as to raise the blanket cylinder 92 to prevent the blanket 12 from being brought into contact with the surfaces of the form plate 10 and the surface onto which matter is to be printed 11 when the blanket cylinder 92 is returned to the position shown in the figure after completion of the printing.

In printing using the above offset type printing press, the form plate 10 and the surface onto which matter is to be printed 11 are first set in predetermined positions on the stand board 91, and the ink image is formed on the surface of the form plate 10.

The blanket cylinder 92 is then moved to the left hand ends of the rack gears 94.

The air cylinder 95 is operated to lower the blanket cylinder 92, to respectively engage the pinion gears 93 and the rack gears 94 with each other as well as to so set the height of the blanket cylinder 92 such that the blanket 12 wound around the outer peripheral surface of the blanket cylinder 92 is brought into contact with the surface of the form plate 10 and thence the surface onto which the matter is to be printed 11 at a predetermined pressure (nip pressure).

In this state, when the blanket cylinder 92 is moved further along the plane which includes the surfaces of the form plate 10 and the surface to be printed on 11, as indicated by the arrow, the blanket cylinder 92 starts to rotate on its axis by the engagement of the pinion gears 93 and the rack gears 94.

The blanket cylinder 92 rotates on its axis in a state where the blanket 12 wound around the outer peripheral surface of the blanket cylinder 92 is in contact with the surface of the form plate 10, so that the ink image on the surface of the form plate 10 is transferred to the surface of the blanket 12, after which the blanket cylinder 92 continues to rotate on its axis in a state where the blanket 12 is then brought into contact with the surface onto which the matter is to be printed 11, so that the ink image is printed from the blanket 12 onto the surface to be printed on 11.

The air cylinder 95 is then operated to raise the blanket cylinder 92 after completion of the printing, to release the engagement of the pinion gears 93 and the rack gears 94 as well as to set the height of the blanket cylinder 92 so that the blanket 12 is disengaged from the surfaces of the form plate 10 and the surface to be printed on 11, after which the blanket cylinder 92 is moved in the opposite direction to the direction indicated by the arrow and is returned to the position shown in the figure, whereby printing has been done once.

In the above offset printing press for lithography, the processing precision of the pinion gears 93 and the rack gears 94 greatly affects printing precision.

However, it is difficult to finish the gears in precision of ±1 micron. Therefore, this is one large factor which makes it impossible to do high-precision printing required for making the color filter, the electronic circuit, or the like in the offset printing press.

Specifically, in a printing method using the above conventional offset printing press for lithography, in the step of transferring the ink image to the surface of the blanket 12 from the form plate 10, relative errors are produced between the relative movement by reason of blanket cylinder 92 and the form plate 10, and the rotation of the blanket cylinder 92 on its axis. These are often due to variation in the precision with which the pinion gears 93 and the rack gears 94 are made and engaged. Therefore, dimensional errors are produced in the transferred ink image with respect to the precise ink image on the form plate 10 as a result of the above errors.

Also, in the step of printing the ink image which has been transferred to the surface of the blanket 12 and then onto the surface to be printed on 11, relative errors are produced between the relative movement by the blanket cylinder 92 and the surface to be printed on 11 and the rotation of the blanket cylinder 92 on its axis. These errors are also often due to variation in the precision with which the pinion gears 92 and the rack gears 94 have been made and assembled. Therefore, dimensional errors in the printing step are added to the dimensional errors in the transferring step, whereby the ink image printed on the surface to be printed on 11, has a resulting decreased printing precision.

SUMMARY OF THE INVENTION

An object of the present invention is to provide an offset printing method with which high-precision printing can be carried out.

In order to solve the above problems, the offset printing method of the present invention comprises:

a step for transferring an ink image formed on the surface of a form plate to the surface of a printing blanket wound around an outer peripheral surface of a blanket cylinder by rotating the blanket cylinder on its axis while relatively moving the blanket cylinder along the surface of the form plate in a state where the blanket is brought into contact with the surface of the form plate; and a step for printing the ink image, transferred to the surface of the printing blanket, onto the surface to be printed on by rotating the blanket cylinder on its axis while relatively moving the blanket cylinder along the surface to be printed, in a state where the blanket, to which the ink image is transferred, is brought into contact with the surface of the matter to be printed, wherein relative errors, produced between the relative movement between the blanket cylinder and the form plate and the rotation of the blanket cylinder on its axis in the transferring step, are canceled by relative errors produced between the relative movement between the blanket cylinder and the surface to be printed on and the rotation of the blanket cylinder on its axis in the printing step.

According to the offset printing method of the present invention, the above relative errors produced in the transferring step can be reproduced and cancelled as accurately as possible in the printing step. Therefore, the dimensional errors produced in the ink image transferred to the surface of the printing blanket can be canceled by the dimensional errors produced in printing the ink image on the surface to be printed on, whereby higher-precision printing than the conventional printing is possible.

The foregoing and other objects and advantages of the present invention will become more apparent from the following detailed description of the present invention.

DESCRIPTION OF THE PREFERRED EMBODIMENTS

Figure 1A:
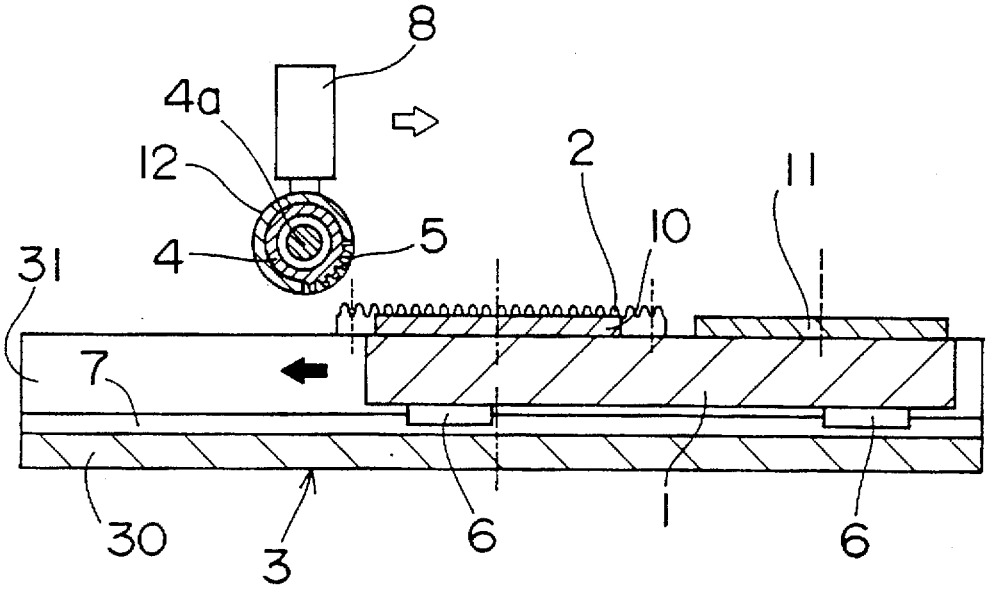
FIG. 1(*a*) is a cross sectional view showing one example of an offset printing press according to the present invention, and FIG. 1(*b*) is a plan view thereof.

An offset printing method according to the present invention will be described while referring to the drawings.

Figure 1B:
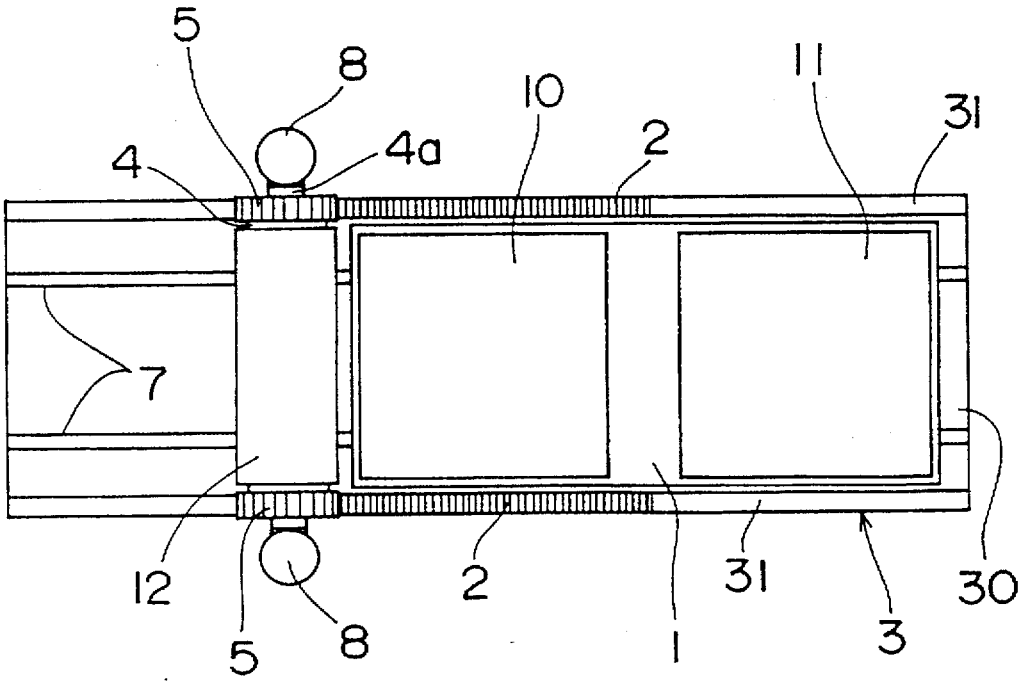

An offset printing press shown in FIGS. 1(*a*) and 1(*b*) comprises a stand board 1 having a flat plate-shaped form plate 10 fixed to its surface the stand board 1 also serves as a platform for holding a surface to be printed on 11 at a predetermined spacing from the form plate 10, so that the surface of the form plate 10 and the surface to be printed on 11 are flush with each other. A base stand 3 is provided having a pair of rack gears 2 which are parallel to a plane which includes the surfaces of the form plate 10 and the surface to be printed on 11. The base stand 3 is fixed on both sides of the stand board 1 for supporting the stand board 1. A blanket cylinder 4, having a blanket 12 wound around its outer peripheral surface, and pinion gears 5 respectively mounted on both ends of the blanket cylinder 4 and engageable with the rack gears 2 are also provided.

The stand board 1 is so supported as to be movable along the plane including the surface of the form plate 10 and the surface to be printed on 11, on a rail 7 laid on an upper surface of a bottom plate 30 of the base stand 3 by moving means 6 of a linear motor type mounted on its lower surface, whereby the stand board 1 and the rack gears 2 fixed to the base stand 3 are relatively movable.

The moving means 6 can stop the stand board 1 with high precision in an arbitrary position on the rail 7. Two stop positions are provided. A first stop position (a position as shown in the figure) is where the stand board 1 is so stopped that a centerline of the form plate 10 indicated by a one-dot and dash line in FIG. 1(*a*) coincides with a centerline of the base stand 3 indicated by a two-dot and dash line in FIG. 1(*a*). A second stop position is where the stand board 1 is so stopped that a centerline of the surface to be printed on 11 indicated by a long broken line in FIG. 1(*a*) coincides with the centerline of the base stand 3 are set.

The base stand 3 for supporting the stand board 1 is in an inverted Π shape in cross section, and is made up of a bottom plate 30 and two side plates 31. The rail 7 is laid on the upper surface of the bottom plate 30, and the rack gears 2, respectively engaged with the pinion gears 5, are fixed to the centers in the length direction of upper ends of both side plates 31, respectively.

The number of teeth and the length of the rack gear 2 are so set that the pinion gear 5 rotates just once, that is, the blanket cylinder 4 rotates on its axis once while the pinion gear 5 is moved between a position where rotation on its axis is started (a broken line on the left side) and a position where rotation on its axis is terminated (a broken line on the right side) as indicated by two short broken lines in FIG. 1(*a*).

The blanket cylinder 4 is so disposed as to be movable, together with an air cylinder 8, along the plane including the surfaces of the form plate 10 and the surface to be printed on 11 with respect to the stand board 1, as indicated by a white arrow in FIG. 1(*a*), in a state where both ends of its axis **4*a* are rotatably held in the leading end of air cylinders 8**, similarly to the conventional blanket cylinder.

The air cylinder 8 is for changing the height of the blanket cylinder 4 in two stages in order to bring the blanket 12, wound around the outer peripheral surface of the blanket cylinder 4, into contact with the surface of the form plate 10 in a transferring step and into contact with the surface of the surface to be printed on 11 in a printing step, as well as to raise the blanket cylinder 4 to prevent the blanket 12 from being brought into contact with the surfaces of the form plate 10 and the surface to be printed on 11 when the blanket cylinder 4 is returned to the position as shown in the figure at the respective time points where the transferring step and the printing step are terminated.

When printing is done using the offset printing press comprising the above sections, the form plate 10 and the matter to be printed 11 are first set in predetermined positions of the stand board 1, and an ink image is formed on the surface of the form plate 10.

The stand board 1 is then moved by the moving means 6, to stop the stand board 1 in the first stop position shown in the figure, that is, the position where the centerline of the form plate 10 (indicated by the one-dot and dash line) coincides with the centerline of the base stand 3 (indicated by the two-dot and dash line), and the blanket cylinder 4 is moved to the position indicated by the short broken line on the left side of the rack gears 2, that is, the position where rotation on its axis is started.

The air cylinder 8 is operated to lower the blanket cylinder 4, to respectively engage the pinion gears 5 and the rack gears 2 with each other as well as to set the height of the blanket cylinder 4 such that the blanket 12 wound around the outer peripheral surface of the blanket cylinder 4 is brought into contact with the surface of the form plate 10 at a predetermined pressure (nip pressure).

In this state, when the blanket cylinder 4 is moved along the plane including the surface of the form plate 10 and the surface to be printed on 11, as indicated by the white arrow, the blanket cylinder 4 starts to rotate on its axis by the engagement of the pinion gears 5 and the rack gears 2.

The blanket cylinder 4 rotates on its axis in a state where the printing blanket 12 wound around the outer peripheral surface of the blanket cylinder 4 is brought into contact with the surface of the form plate 10, so that the ink image on the surface of the form plate 10 is transferred to the surface of the blanket 12 (the transferring step).

In the stage where the blanket cylinder 4 is moved while rotating on its axis to the position indicated by the short broken line on the right side of the rack gears 2, that is, the position where rotation on its axis is terminated, the movement in a direction indicated by the white arrow of the blanket cylinder 4 is stopped, and the air cylinder 8 is operated to raise the blanket cylinder 4, to release the engagement of the pinion gears 5 and the rack gears 2 as well as to set the height of the blanket cylinder 4 such that the blanket 12 is not brought into contact with the surface of the form plate 10, after which the blanket cylinder 4 is moved in the opposite direction of the direction indicated by the arrow and is returned to the position shown in the figure.

The stand board 1 is then moved by the moving means 6, to stop the stand board 1 in the second stop position where the centerline of the surface to be printed on 11 (indicated by the long broken line) coincides with the centerline of the base stand 3 (indicated by the two-dot and dash line) this time, and the blanket cylinder 4 is moved to the position indicated by the short broken line on the left side of the rack gears 2, that is, the position where rotation on its axis is started.

The air cylinder 8 is operated to lower the blanket cylinder 4, to respectively engage the pinion gears 5 and the rack gears 2 with each other as well as to set the height of the blanket cylinder 4 such that the printing blanket 12 wound around the outer peripheral surface of the blanket cylinder 4 is brought into contact with the surface to be printed on 11 at a predetermined pressure (nip pressure).

In this state, the pinion gear 5 and the rack gear 2 are engaged with each other in the same positions of their respective identical teeth to those in the previous transferring step.

When the blanket cylinder 4 is moved along the plane including the surface of the form plate 10 and the surface to be printed on 11, as indicated by the arrow, the blanket cylinder 4 starts to rotate on its axis in exactly the same rotating state by the engagement of the pinion gear 5 and the rack gear 2 in the respective identical teeth to those in the previous transferring step.

The blanket cylinder 4 rotates on its axis in entirely the same rotating state as that in the previous transferring step in a state where the printing blanket 12 wound around the outer peripheral surface of the blanket cylinder 4 is brought into contact with the surface to be printed on 11, whereby the ink image transferred to the surface of the printing blanket 12 is printed on the surface to be printed on 11 (the printing step).

In the stage where the blanket cylinder 4 is moved while rotating on its axis to the position indicated by the short broken line on the right side of the rack gears 2, that is, the position where rotation on its axis is terminated, when the movement of the blanket cylinder 4 is stopped, and the air cylinder 8 is operated to raise the blanket cylinder 4, to release the engagement of the pinion gears 5 and the rack gears 2 as well as to set the height of the blanket cylinder 4 so that the printing blanket 12 is not permitted to contact the surface to be printed on 11, after which the blanket cylinder 4 is moved in the opposite direction, to the direction indicated by the arrow and is returned to the position shown in the figure. Thereby printing has been done once.

As described in the foregoing, according to a printing method using the offset printing press shown in FIGS. 1(*a*) and 1(*b*), when the ink image on the surface of the form plate 10 is transferred to the surface of the printing blanket 12, and when the ink image is then printed on the surface to be printed on 11, the rack gear 2 and the pinion gear 5 are engaged with each other in the same positions of their respective identical teeth. Thus, the blanket cylinder 4, with the printing blanket 12 thereon, can be rotated on its axis in exactly the same rotating state in the above two steps.

According to the offset printing method of this invention, therefore, relative errors, caused by the relative movement between the blanket cylinder 4 and the form plate 10 and the rotation of the blanket cylinder 4 on its axis, which are produced in the image transferring step, due to processing variation in the processing precision of engagement of the rack gears 2 and the pinion gears 5, can be reproduced in the relative movement between the blanket cylinder 4 and the surface to be printed on 11 and the rotation of the blanket cylinder 4 on its axis in the printing step by the engagement of the rack gear 2 and the pinion gear 5 in the same positions of their respective identical teeth. Consequently, when the ink image is printed on the surface to be printed on 11, dimensional errors produced in transferring the ink image to the surface of the printing blanket 12 are cancelled by the above errors in the transferring step of the image from the printing blanket 12 to the surface to be printed on 11, whereby higher-precision printing can be done.

The adjustment of the nip pressure between the form plate 10 and the printing blanket 12 and between the printing blanket 12 and the surface to be printed on 11, which is not illustrated, may be made by adjusting the heights of the form plate 10 and of the surface to be printed on 11 using a bearer, as in a conventional offset printing press for lithography.

In the offset printing press shown in FIGS. 1(*a*) and 1(*b*), the rack gears 2 are fixed to the base stand 3, and the stand board 1 is movable with respect to the base stand 3. Conversely, however, the stand board 1 may be fixed, and the rack gears 2 may be movable.

In the offset printing press shown in FIGS. 1(*a*) and 1(*b*), the blanket cylinder 4 is moved with respect to the stand board 1 and the rack gears 2 which are stopped. Conversely, however, the blanket cylinder 4 may be fixed, and the stand board 1 and the rack gears 2 may be moved.

A mounting section, where the form plate 10 or the surface to be printed on 11 is to be mounted, may be provided in a predetermined position with respect to the rack gears 2, and the form plate 10 and the matter to be printed on 11 may be alternately mounted on the mounting section using an industrial robot, for example.

In the offset printing press shown in FIGS. 1(*a*) and 1(*b*), both the form plate 10 and the surface to be printed on 11 are in a flat plate shape. In the case of a flexible surface to be printed on 11 such as a plastic film, however, the form plate 10 may be in a drum shape, and the surface to be printed on 11 may be wound around a drum. In the case, the rack gear 2 is replaced with a disc-shaped or circular arc-shaped gear which is similarly engaged with the pinion gear 5. The gear may be relatively moved between the drum of the form plate 10 and the drum around which the matter to be printed on 11 is wound, or both the drums may be alternately mounted on the mounting section provided in a predetermined position with respect to the disc-shaped or the circular arc-shaped gear.

Alternatively, the blanket cylinder 12 may be rotated on its axis in the transferring step and the printing step not by the engagement of the gears but the frictional contact between the bearer mounted on the blanket cylinder and a pillow arranged in a predetermined position with respect to the form plate and the surface to be printed on. When the same pillow is shared by the form plate and the surface to be printed on, and the bearer and the pillow are brought into frictional contact with each other in exactly the same position in both steps, the relative errors caused by the relative movement between the blanket cylinder and the form plate and the rotation of the blanket cylinder on its axis can be reproduced in the relative movement between the blanket cylinder and the surface to be printed on and the rotation of the blanket cylinder on its axis in the printing step.

Furthermore, when the form plate is in a drum shape, and the surface to be printed on is wound around a drum, as described above, the blanket cylinder, the drum of the form plate, and the drum around which the surface to be printed on is wound may be respectively driven to rotate by separate motors, and a motor of the blanket cylinder and a motor of the drum of the form plate, and the motor of the blanket cylinder and a motor of the surface to be printed on may be rotated electrically in synchronism with each other, respectively, in the transferring step and the printing step. Also in this case, relative errors between the relative movement between the blanket cylinder and the form plate and the rotation of the blanket cylinder on its axis which are produced in the transferring step can be reproduced in the relative movement between the blanket cylinder and the surface to be printed and the rotation of the blanket cylinder on its axis in the printing step.

As described in the foregoing, according to the offset printing method in the present invention, when the ink image transferred to the surface of the blanket is printed on the surface to be printed, the dimensional errors produced in the ink image is canceled, thereby enabling higher-precision printing.

EXAMPLES

The present invention will be described on the basis of an example and a comparative example.

Example

A form plate was produced having such a pattern that 640 stripes each having a width of 35 μm with spacing of 300 μm in width in the longitudinal direction, i.e., a direction parallel to a direction in which the blanket cylinder is moved and 1920 stripes with spacing of 100 μm in width in the transverse direction, i.e., a direction perpendicular to the above direction are arranged in a lattice shape. This form plate was set on the offset printing press shown in FIGS. 1(*a*) and 1(*b*), an ink image corresponding to the above pattern was continuously printed on the surfaces of ten-pieces of glass substrates, which are surfaces to be printed on using black ink for glass.

Comparative Example

Figure 2A:
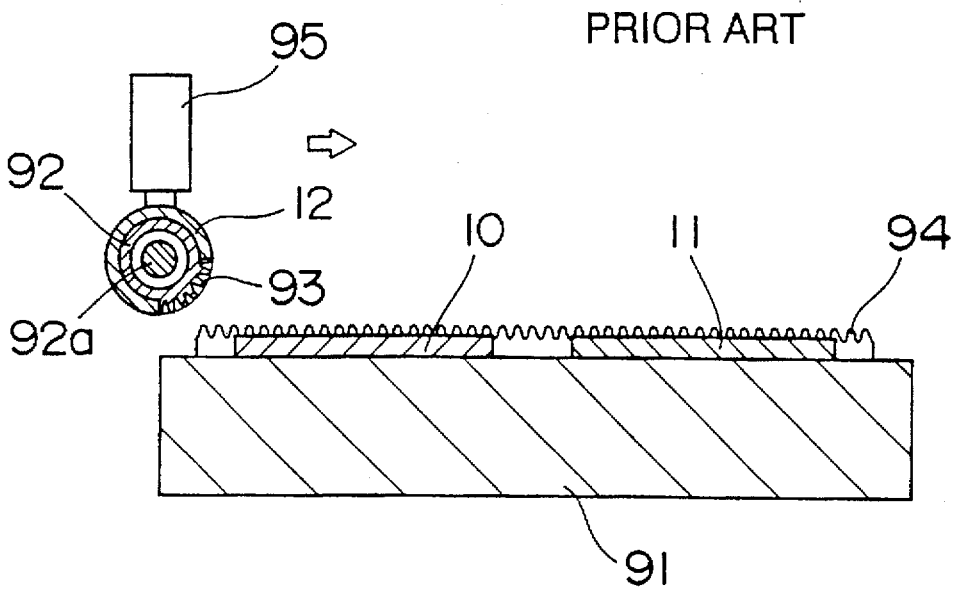
FIG. 2(a) PRIOR ART
FIG. 2(*a*) is a cross sectional view showing one example of a conventional offset printing press, and FIG. 2(*b*) is a plan view thereof.
Figure 2B:
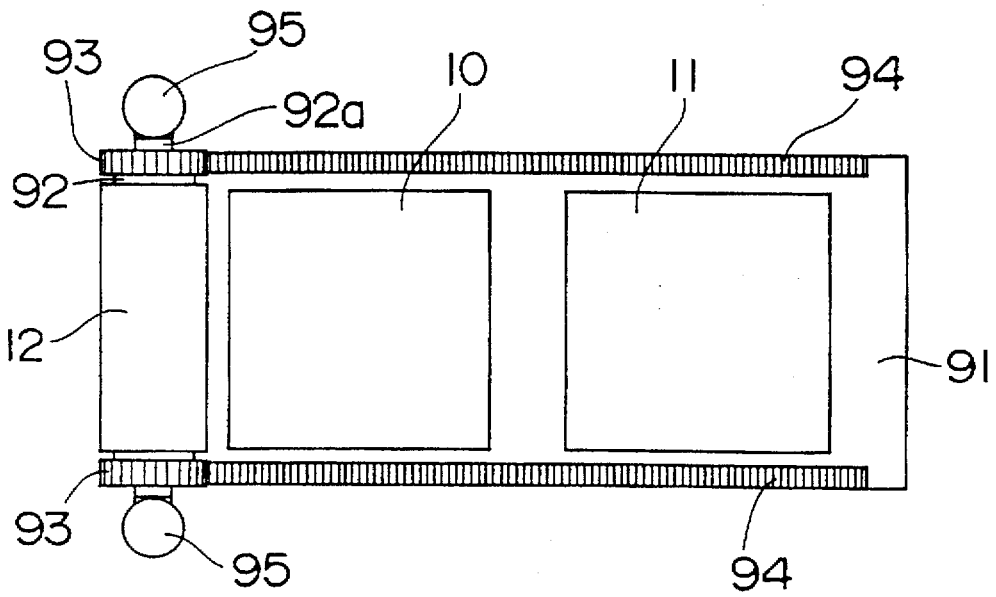
FIG. 2(b) PRIOR ART

The above form plate was set in the conventional offset printing press shown in FIGS. 2(*a*) and 2(*b*), and an ink image corresponding to the above pattern was continuously printed on the surfaces of ten-pieces of glass substrates, which are surface to be printed on, using black ink for glass.

The absolute values of the amounts of shift in the longitudinal direction of thirty-portions of the stripes in the transverse direction from corresponding positions of the form plate in prints obtained in the example and the comparative example were measured, and the absolute values of the amounts of the shift in the transverse direction of thirty-portions of the stripes in the longitudinal direction from corresponding positions of the form plate were measured.

The measurements were respectively made with respect to ten samples, and the results thereof were averaged. As a result, the shift in the longitudinal direction of the stripes in the transverse direction was 1.5 μm in a case where the printing press according to the example was used, and was 8.1 μm in a case where the printing press in the comparative example was used. On the other hand, the shift in the transverse direction of the stripes in the longitudinal direction was 1.4 μm in a case where the printing press according to the example was used, and was 5.9 μm in a case where the printing press in the comparative example was used.

From the above results, it is confirmed that printing precision is noticeably improved by using the offset printing press and method in the example of this invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An offset printing method comprising:

a transferring step for transferring an ink image formed on a surface of a form plate to a surface of a blanket wound around an outer peripheral surface of a blanket cylinder by 1) moving one of the form plate and the blanket cylinder to a first position and 2) rotating the blanket cylinder on its axis while relatively moving the blanket cylinder along the surface of the form plate as the blanket is brought into contact with the surface of the form plate; and a printing step for printing the ink image transferred to the surface of the blanket onto a surface to be printed on by 3) moving one of the surface to be printed on and the blanket cylinder to the first position and 4) rotating the blanket cylinder on its axis while relatively moving the blanket cylinder along the surface to be printed on, as the blanket to which said ink image has been transferred is brought into contact with the surface to be printed on, wherein relative errors produced by relative movement between a) the blanket cylinder and the form plate and b) the rotation of the blanket cylinder on its axis in said transferring step are canceled by relative errors produced by relative movement between c) the blanket cylinder and the surface to be printed on and d) the rotation of the blanket cylinder on its axis in said printing step, wherein the step of rotating the blanket cylinder on its axis during the transferring step and the printing step further includes the step of engaging a first gear, mounted on the blanket cylinder, and a second gear arranged in a predetermined position with respect to the form plate and the surface to be printed on, wherein the second gear is shared by the form plate and the surface to be printed on, and wherein the step of engaging the first gear on the blanket cylinder and the second gear of the form plate and the surface to be printed on further includes the step of meshing said first and second gears with each other in the same positions of their respective identical teeth in both said transferring and printing steps, wherein the errors caused by the relative movement between a) the blanket cylinder and the form plate and b) the rotation of the blanket cylinder on its axis which are produced in the transferring step, are reproduced in the relative movement between c) the blanket cylinder and the surface to be printed on and d) the rotation of the blanket cylinder on its axis in the printing step.

2. In an offset printing method comprising:

disposing an assembly of an inked plate and a print receiving surface on a common support such that the ink receiving surface of said plate and the image receiving surface of said print receiving surface are coplanar;

disposing a rack gear on a support on each side of said assembly parallel to said coplane and substantially equal in length to at least the lengths one of said inked plate or said print receiving surface;

disposing a rotatable printing blanket spaced from the plane of said assembly and axially parallel to the plane of said assembly;

disposing a pinion gear on each end of said printing blanket operatively engageable with said rack gears;

engaging said pinion and rack gears at an initial point of said inked plate;

rolling said printing blanket against said inked plate by engagement of said rack and pinion gears, under conditions sufficient to transfer an ink image from said inked plate to said printing blanket; and continuing to roll the printing blanket in the same direction relative to said plate, by continued engagement of said rack and pinion gears, to rollingly engaging said inked printing blanket with said print receiving surface under conditions sufficient to transfer the inked image on the printing blanket to print receiving surface;

the improvement which comprises:

disposing said inked plate and said print receiving surface assembly on a first support;

disposing rack gears, of a shorter length equal to the length of the inked plate, on a second support which is separate from said first support, while maintaining said shorter rack gears in substantially the same spacial relationship to said inked plate as heretofore;

rollingly engaging said pinion gears with a first end of said rack gears, while maintaining said inked plate in a fixed position relative to said rack gears;

rollingly engaging said printing blanket with said inked plate and moving said pinion gears and printing blanket relative to said rack gears and said inked plate, respectively, under conditions sufficient to transfer an inked image from said inked plate to said printing blanket;

disengaging said printing blanket and pinion gears from said inked plate and rack gears, respectively;

moving said printing blanket and associated pinion gears into proximity to said first end of said rack gears;

moving said first support relative to said rack gears such that said print receiving surface is in substantially the same position relative to said rack gears as said inked plate had been relative to said rack gears during transfer of the ink image from the inked plate to the printing blanket;

again, engaging said pinion gears with said first end of said rack gears, while maintaining said print receiving surface in a fixed position relative to said rack gears;

rollingly engaging said pinion gears with said rack gears and said printing blanket with said print receiving surface, respectively, under conditions sufficient to transfer an inked image from said printing blanket to said print receiving surface.

3. An offset printing apparatus comprising:

a first support;

an assembly of an inked plate and a print receiving surface on said first support;

a second support adjacent said first support;

two rack gears on said second support, one on each side of said assembly, wherein the length of said rack gears is at least equal to the length of said inked plate;

a rotatable printing blanket disposed proximate to said assembly;

two pinion gears disposed on opposite sides of said printing blanket in engaging and disengaging relationship to said rack gears;

means to dispose a first end of said inked plate proximate to a first end of said rack gears and proximate to said printing blanket;

means to engage said pinion gears with said first end of said rack gears proximate to said first end of said inked plate;

means to rollingly engage said rack gears and associated inked plate, and said pinion gears and associated printing blanket, respectively, under conditions sufficient to transfer an ink image from said inked plate to said printing blanket;

means to disengage said printing blanket and said associated pinion gears from said inked plate and rack gears, respectively;

means to position said printing blanket and associated pinion gears proximate to said first end of said rack gears and disengaged therefrom;

means to dispose a first end of said print receiving surface proximate to a first end of said rack gears and proximate to said disengaged printing blanket;

means to engage said pinion gears with said first end of said rack gears and to engage said printing blanket with said first end of said print receiving surface;

means to rollingly engage said rack gears and associated print receiving surface, and said pinion gears and associated printing blanket, respectively, under conditions sufficient to transfer an ink image from said printing blanket to said receiving surface.

4. An offset printing apparatus as claimed in claim 3 wherein said pinion gears engage the same teeth of said rack gears when said printing blanket first engages said inked plate as when said printing blanket first engages said print receiving surface.

* * * * *